US005687050A

United States Patent [19]

Bartsch

[11] Patent Number: 5,687,050

[45] Date of Patent: Nov. 11, 1997

[54] ELECTRONIC CONTROL CIRCUIT FOR AN INTERNAL COMBUSTION ENGINE

[75] Inventor: Knut Bartsch, Ebersberg, Germany

[73] Assignee: Ficht GmbH, Kirchseeon, Germany

[21] Appl. No.: 506,880

[22] Filed: Jul. 25, 1995

[51] Int. Cl.[6] ..... H01H 47/28

[52] U.S. Cl. ..... 361/154; 361/187; 123/490

[58] Field of Search ..... 361/152, 154, 361/160, 170, 187; 123/490–494, 497, 499

[56] References Cited

U.S. PATENT DOCUMENTS

| | | | |
|---|---|---|---|
| 3,786,314 | 1/1974 | Misch | 317/154 |
| 4,225,898 | 9/1980 | Weber et al. | 361/154 |
| 4,300,508 | 11/1981 | Streit et al. | 123/490 |
| 4,327,695 | 5/1982 | Schecter | 123/504 |
| 4,355,620 | 10/1982 | Seilly et al. | 123/499 |
| 4,358,812 | 11/1982 | LoCascio et al. | 361/152 |
| 4,438,496 | 3/1984 | Ohie | 364/431 |
| 4,479,161 | 10/1984 | Henrich et al. | 361/154 |
| 4,492,913 | 1/1985 | Arnold et al. | 323/282 |
| 4,541,389 | 9/1985 | Kosak et al. | 123/490 |
| 4,543,891 | 10/1985 | O'Sullivan et al. | 110/185 |
| 4,603,669 | 8/1986 | Takemoto et al. | 123/357 |
| 4,604,036 | 8/1986 | Sutou et al. | 417/18 |
| 4,604,675 | 8/1986 | Pflederer | 361/155 |
| 4,715,353 | 12/1987 | Koike et al. | 123/590 |
| 4,718,386 | 1/1988 | Gieles | 123/472 |
| 4,726,738 | 2/1988 | Nakamura et al. | 417/221 |
| 4,756,291 | 7/1988 | Cummins et al. | 123/497 |
| 4,776,314 | 10/1988 | Krauter et al. | 123/490 |
| 4,787,823 | 11/1988 | Hultman | 417/45 |
| 4,950,974 | 8/1990 | Pagano | 323/222 |
| 4,953,056 | 8/1990 | Yakuwa et al. | 361/154 |
| 5,053,911 | 10/1991 | Kopec et al. | 361/154 |
| 5,214,561 | 5/1993 | Morita | 361/187 |
| 5,216,994 | 6/1993 | Aoki et al. | 123/490 |
| 5,267,545 | 12/1993 | Kitson | 123/490 |
| 5,347,419 | 9/1994 | Caron et al. | 361/154 |
| 5,442,515 | 8/1995 | Wallaert | 361/187 |

FOREIGN PATENT DOCUMENTS

| | | | |
|---|---|---|---|
| 0075303 | 9/1982 | European Pat. Off. | F02D 5/02 |
| 3727122 | 2/1989 | Germany | G05F 1/10 |
| 88/07130 | 9/1988 | WIPO | F02D 41/20 |
| 93/18290 | 9/1993 | WIPO | F02D 41/20 |

*Primary Examiner*—Brian K. Young
*Assistant Examiner*—Michael J. Sherry
*Attorney, Agent, or Firm*—Jones, Day, Reavis & Pogue

[57] ABSTRACT

An internal combustion engine assembly including a solenoid pump having an armature and a solenoid winding encircling the armature such that the armature moves in response to current flow, including unwanted current variations, through the solenoid winding and a control circuit connected to the solenoid winding for detecting unwanted variable current flow in the solenoid winding and for controlling actual current flow in the solenoid winding in response to the detected unwanted variable current flow to thereby precisely control movement of the armature.

10 Claims, 2 Drawing Sheets

ELECTRONIC CONTROL CIRCUIT FOR AN INTERNAL COMBUSTION ENGINE

BACKGROUND OF THE INVENTION

The invention relates to internal combustion engines, and particularly to an electronic fuel injector control circuit for an internal combustion engine.

It is generally known to include electronically operated or controlled fuel injectors and pumps in internal combustion engines. Various types of fuel injectors and fuel pumps exist, and the electronic controls for such injectors and pumps vary depending upon the nature of the particular injector or pump itself and the requirements of the particular application.

In the case of a solenoidal fuel injector, the movement of the pump piston or armature is controlled by the flow of current through an inductive injector coil or winding. Typically, the injector coil or winding is connected to a voltage source supplied by the distribution system of the engine and is also connected to some means such as a switch for controlling the flow of current through the winding.

SUMMARY OF THE INVENTION

It has been determined that various circuit parameters such as circuit temperatures, coil resistance, and supply voltage ripple can cause the current flowing through the injector winding to vary. This variation in the current flowing through the injector winding necessarily causes a variation in the movement or stroke of the injector armature and a corresponding change in the amount of fuel injected by that injector.

The invention provides an internal combustion engine having a fuel injector and a control circuit for controlling the operation of the fuel injector. The injector includes a solenoid pump having a longitudinal armature and a solenoid winding encircling the armature such that the armature moves longitudinally in response to current flow through the solenoid winding. A current source and a transistor are connected to the solenoid winding. The transistor operates in the active region to precisely control the flow of electrical current from the current source through the solenoid winding. The control circuit includes control means connected to the transistor and to the solenoid winding so as to detect a variation in the current flow in the solenoid winding and to energize the transistor in response to the variation in current flow to provide a precise control of the movement of the solenoid armature.

The invention also provides an internal combustion engine assembly comprising: a solenoid pump having an armature and a solenoid winding encircling the armature such that the armature moves in response to current flow through the solenoid winding; and a control circuit connected to the solenoid winding for detecting a variation in current flow in the solenoid winding and for controlling precise current flow in the solenoid winding in response to the detected variation in current flow to thereby control movement of the armature to remove variations in the movement of the armature caused by unwanted variations in solenoid winding current.

The invention also provides an internal combustion engine assembly comprising: a solenoid pump having an armature and a solenoid winding encircling the armature such that the armature moves in response to current flow through the solenoid winding; and a control circuit connected to the solenoid winding for controlling actual current flow in the solenoid winding; and a feedback circuit connected to the solenoid pump and to the control circuit, the feedback circuit generating a signal indicative of variations in current flow in the solenoid winding; and the control circuit controlling actual current flow in the solenoid winding in response to the signal from the feedback circuit to thereby corresponding control movement of the armature.

The invention also provides an internal combustion engine assembly comprising: a solenoid having an armature and a solenoid winding encircling the armature such that the armature moves in response to current flow, including unwanted current variations through the solenoid winding; and a control circuit connected to the solenoid winding for controlling actual current flow in the solenoid winding, the control circuit including template means for generating a template signal corresponding to a desired solenoid winding current flow, a comparator for comparing the variable currents flow through the solenoid windings with the template signal and generating a comparator output in response to the comparison, and a transistor connected to the comparator and to the solenoid winding, the transistor operating in the active region to control actual current flow through the solenoid winding in response to the comparator output; and a feedback circuit connected to the solenoid and to the control circuit, the feedback circuit generating a signal indicative of actual current flow in the solenoid winding and the feedback circuit including a current sensing resistor connected to the solenoid winding and an amplifier having an input connected to the current sensing resistor and having an output connected to the comparator, the amplifier generating a current signal corresponding to the unwanted variable current flowing through the solenoid winding.

It is an advantage of the invention to provide a fuel injector and a control circuit therefor, the control circuit including an electronic feedback circuit to monitor the current flowing through the solenoid winding and, in response thereto, precisely controlling the current flowing through the solenoid winding and the corresponding armature movement.

Other features and advantages of the invention are set forth in the following detailed description and claims.

Figure 1:
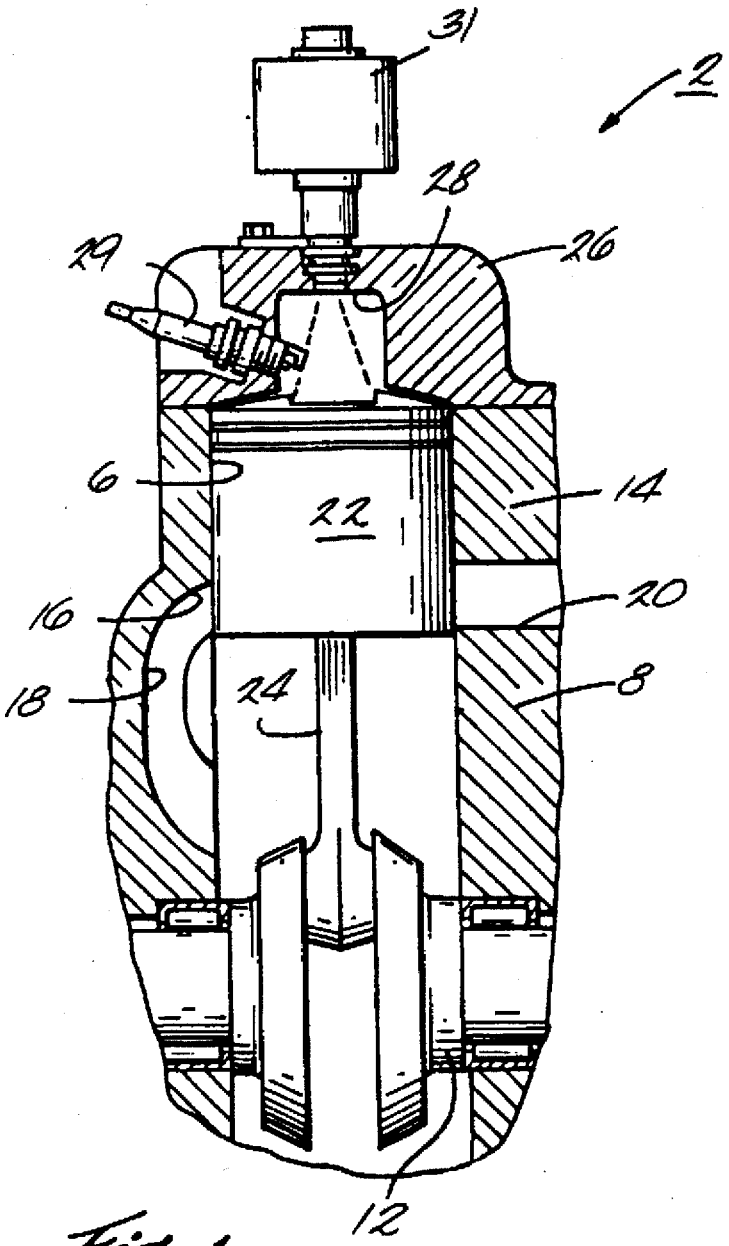
FIG. 1 is a partial cross section of an internal combustion engine embodying the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or carried out in various ways. Also, it is to be understood that the phraseology and terminology used herein is for the purpose of description and should not be regarded as limiting.

DESCRIPTION OF THE PREFERRED EMBODIMENT

Partially shown in FIG. 1 of the drawings is an internal combustion engine 2 embodying the invention. One cylinder 6 of the engine 2 is illustrated in FIG. 1. The engine 2 includes a crankcase 8 defining a crankcase chamber 10 and having a crankshaft 12 rotatable therein. An engine block 14 defines the cylinder 6. The engine block 14 also defines an intake port 16 communicating between the cylinder 6 and the crankcase chamber 10 via a transfer passage 18. The engine block 14 also defines an exhaust port 20. A piston 22 is reciprocally moveable in the cylinder 6 and is drivingly connected to the crankshaft 12 by a crank pin 24. A cylinder head 26 closes the upper end of the cylinder 6 so as to define a combustion chamber 28. A spark plug 29 is mounted on the cylinder head 26 and extends into the combustion chamber 28.

Figure 2:
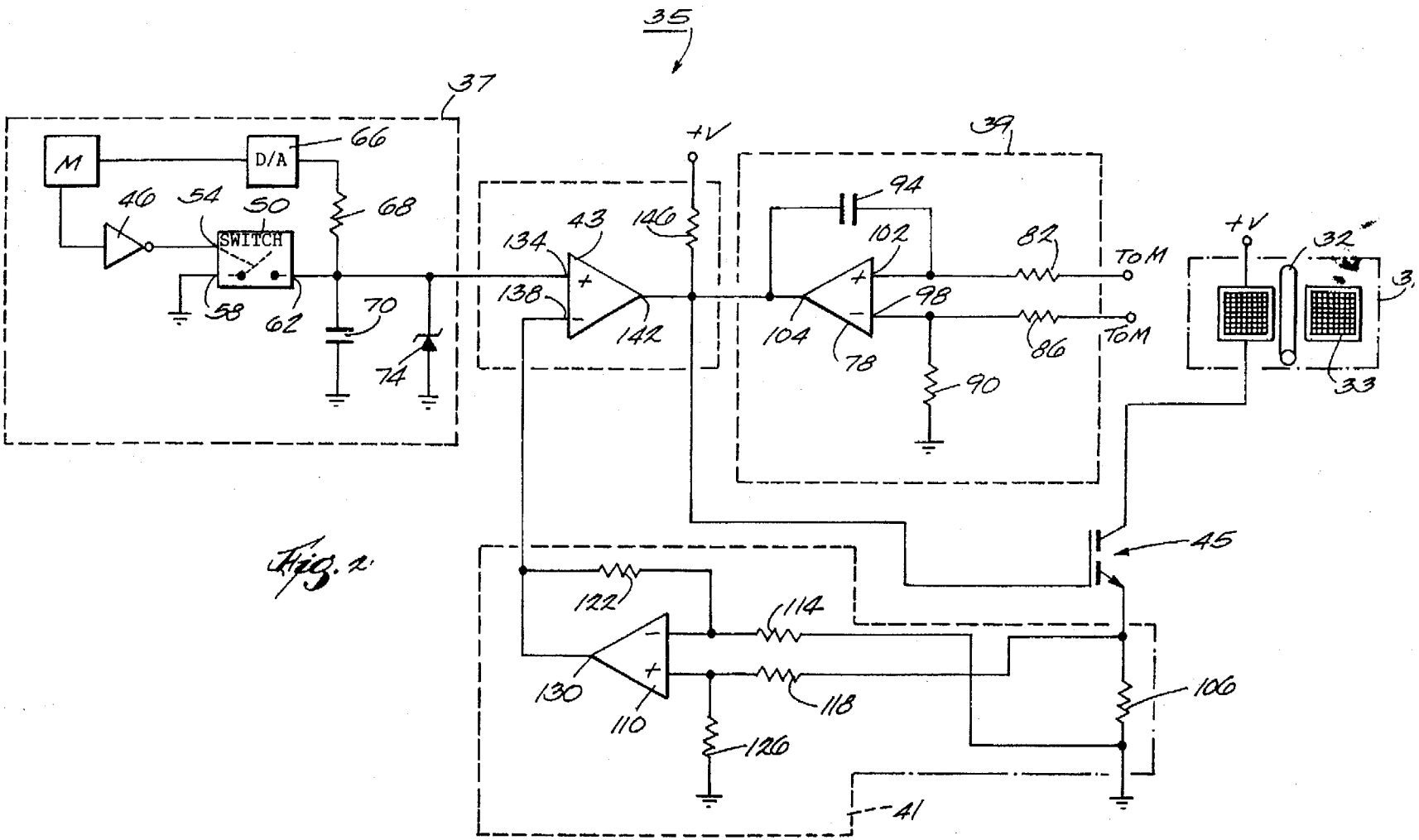
FIG. 2 is a schematic illustration of the electronic control circuit for the internal combustion engine.

The engine 2 also includes a fuel injector or pump 31 mounted on the cylinder head 26 for injecting fuel into the combustion chamber 28. The preferred fuel pump 31 is shown and described in the U.S. Patent Application entitled "COMBINED PRESSURE SURGE FUEL PUMP AND NOZZLE ASSEMBLY" (Attorney Docket No. 72012/7290) which is filed concurrently herewith and which is incorporated herein by reference. The fuel pump or injector 31 includes (see FIG. 2) an armature 32 (shown schematically). The armature 32 is generally elongated and is mounted in the fuel injector for longitudinal movement. The fuel injector 31 also includes a solenoid winding 33 encircling the armature 32. The solenoid winding 33 is connected to an electrical energy supply (+V). As is known in the art, the flow of current through the solenoid winding 33 effects the movement of the armature.

The engine 2 also includes a control circuit 35 for controlling the operation of the fuel pump 31. It should be noted that the control circuit can be used with any internal combustion engine employing any type of solenoid controlled fuel pump or fuel injector. In general terms, the control circuit 35 for controlling the current flow in the solenoid winding 33 includes template means 37 for generating a template signal corresponding to a desired solenoid winding current flow, an injector on/off circuit 39 for starting and stopping operation of the fuel pump 31, a feedback circuit 41 for measuring the actual current flow through the solenoid winding 33, a comparator 43 for comparing the actual current flow through the solenoid winding 33 with the template signal, and a transistor 45 connected to the solenoid winding 33 to control current flowing through the solenoid winding 33 in response to the output of the comparator 43.

More specifically, the template means 37 includes an inverter 46 connected to solid state switch 50 via a control input 54. The switch 50 includes a lead 58 connected to ground and includes a lead 62. The template means 37 also includes a digital to analog convertor ("DAC") 66 connected to the lead 62 of the switch 50 through resistor 68. A microprocessor M, such as, for example, an internal combustion engine electronic control, is connected to the DAC 66 to control the analog output of the DAC 66. A charging capacitor 70 is connected to the lead 62 of switch 50 and in parallel with zener diode 74.

Injector on/off circuit 39 includes an open collector operational amplifier 78, biasing resistors 82, 86 and 90 and filtering capacitor 94. The operational amplifier 78 includes an inverting input 98 and a non-inverting input 102 and receives at the inputs 98 and 102 control signals from the microprocessor to initiate a fuel injection event, i.e., the microprocessor issues control signals to the operational amplifier 78 to turn the operational amplifier 78 on and off to generate a signal at output 104 turning the fuel injector on and off.

The feedback circuit 41 includes resistor 106 connected serially with the solenoid winding 33 and transistor 45. Operational amplifier 110 is connected to resistor 106 through resistors 114 and 118 to receive the voltage across resistor 106 as an input to operational amplifier 110. Resistors 114, 118, 122 and 126 are connected to operational amplifier 110 to bias and set the gain of the operational amplifier 110. Operational amplifier 110 also includes an output 130.

Comparator 43 has a non-inverting input 134 connected to the lead 62 of switch 50 and an inverting input 138 connected to the output 130 of the operational amplifier 110 of feedback circuit 41. The output 142 of the comparator 43 is connected to the output of the operational amplifier 78 of injector on/off circuit 39, to transistor 45 and to a "pull-up" resistor 146 that connects output 142 of comparator 43 and output 104 of operational amplifier 78 to an electrical energy source (+V).

In operation, when the system is at rest, i.e., the fuel injector is not energized, the switch 50 is closed and the lead 62 of switch 50 is connected to ground through lead 58. In this condition, the analog voltage output of the DAC 66 is connected to ground through the switch 50 and no voltage is generated on or stored by capacitor 70. Moreover, because there is no signal from the microprocessor at the inputs 98 and 102 of the injector on/off amplifier 78, amplifier 78 does not generate any output signal and the fuel injector is not energized. Specifically, because operational amplifier 78 is reversed biased, (i.e., the inverting input is greater than the non-inverting input), the transistor 45 has no biasing current and therefore is off, preventing the solenoid winding 33 from conducting any current.

When the microprocessor determines that an injection of fuel is necessary, it generates an injection control signal at the input of the inverter 46 and at the non-inverting input 102 of operational amplifier 78 of the injector on/off circuit 39. This causes operational amplifier 78 to generate an output and this output biases transistor 45 to conduct current thereby energizing the fuel injector.

At approximately the same time, the injector control signal at inverter 46 causes switch 50 to open. Opening of switch 50 disconnects the non-inverting input 134 of comparator 43 from ground thereby allowing the analog output of the DAC 66 to charge capacitor 70 to provide a reference for comparator 43. DAC 66 charges capacitor 70 to a voltage level corresponding to the ideal current flow level for the solenoid winding 33. The ideal current flow level is based on the engine operating parameters and conditions and is set by the microprocessor. As current flows through the solenoid winding 33, transistor 45 and resistor 106, a voltage develops across resistor 106. This voltage is amplified by operational amplifier 110 and transmitted via output 130 to the inverting input 138 of comparator 43. Comparator 43 generates an output based on a comparison of voltage signal representing the ideal current flow level coming from the microprocessor and the DAC 66 and voltage signal representing the actual current flow from operational amplifier 110 to adjust the bias level of the transistor 45 and thereby regulate the flow of current through the solenoid.

The provision of a feedback loop for adjusting the operating current of the fuel injector eliminates or reduces the effects that changes in the various circuit parameters may have on the flow of current through the injector winding 33. The provision of a fuel injector current that is resistant to variations in circuit parameters results in a consistent injection of fuel into the cylinder(s) of the internal combustion engine 2 and consistent operation of the internal combustion engine 2.

Various features and advantages of the invention are set forth in the following claims.

I claim:

1. An internal combustion engine assembly comprising:

a solenoid pump having an armature and a solenoid winding encircling said armature such that said armature moves in response to actual current flow through said solenoid winding, unwanted variations in said actual current flow causing corresponding unwanted variations in movement of said armature; and a control circuit connected to said solenoid winding for detecting said variations in actual current flow in said solenoid winding and for precisely controlling ideal current flow in said solenoid winding in response to the variations in detected current flow to remove said corresponding unwanted variations in the movement of said armature.

2. An assembly as set forth in claim 1 wherein said control circuit includes a current sensing resistor connected to said solenoid winding and an amplifier connected to said current sensing resistor, said amplifier generating a variable current signal corresponding to said variation in current flowing through said solenoid winding.

3. An assembly as set forth in claim 2 wherein said control circuit includes template means for generating a template signal corresponding to a desired solenoid winding current flow and a comparator for comparing said variable current signal with said template signal.

4. An assembly as set forth in claim 1 wherein said control circuit includes a transistor connected to said solenoid winding, said transistor operating in the active region to precisely control ideal current flow through said solenoid winding, and corresponding armature movement, in response to said variations in detected current flow.

5. An internal combustion engine assembly comprising:

a solenoid pump having an armature and a solenoid winding encircling said armature such that said armature moves in response to current flow through said solenoid winding, unwanted variation in said current flow causing corresponding unwanted variations in the movement of said armature;

a control circuit connected to said solenoid winding for precisely controlling ideal current flow in said solenoid winding to control precise movement of said armature;

a feedback circuit connected to said solenoid pump and to said control circuit, said feedback circuit generating a signal indicative of said unwanted variations in current flow in said solenoid winding; and said control circuit precisely controlling said ideal current flow in said solenoid winding in response to the signal from said feedback circuit to remove said corresponding variations in said armature movement and thereby effect precise control of the movement of said armature.

6. An assembly as set forth in claim 5 wherein said feedback circuit includes a current sensing resistor connected to said solenoid winding and an amplifier connected to said current sensing resistor, said amplifier generating a detected current signal corresponding to the unwanted variations in current flowing through said solenoid winding.

7. An assembly as set forth in claim 6 wherein said control circuit includes template means for generating a template signal corresponding to a desired actual solenoid winding current flow and a comparator for comparing said detected variable current signal with said template signal.

8. An assembly as set forth in claim 7 wherein said template means includes a digital to analog converter for generating a voltage indicative of an ideal actual current flow through said solenoid winding.

9. An assembly as set forth in claim 5 wherein said control circuit includes a transistor connected to said solenoid winding, said transistor operating in the active region to precisely control ideal current flow through said solenoid winding, and corresponding armature movement, in response to said variations in detected current flow.

10. An internal combustion engine assembly comprising:

a solenoid having an armature and a solenoid winding encircling said armature such that said armature moves in response to actual current flow through said solenoid winding, unwanted variations in said actual current flow causing corresponding unwanted variations in movement of said armature;

a control circuit connected to said solenoid winding for controlling said actual current flow in said solenoid winding, said control circuit including template means for generating a template signal corresponding to a desired ideal solenoid winding current flow, a comparator for comparing said actual current flow with said template signal and generating a comparator output in response to said comparison, and a transistor connected to said comparator and to said solenoid winding, said transistor operating in the active region to precisely control both current flow through said solenoid winding and the corresponding armature movement in response to said comparator output; and a feedback circuit connected to said solenoid and to said control circuit, said feedback circuit generating a signal indicative of said unwanted variations in current flow in said solenoid winding and said feedback circuit including a current sensing resistor connected to said solenoid winding and an amplifier having an input connected to said current sensing resistor and having an output connected to said comparator, said amplifier generating a variable current output signal corresponding to the unwanted variations in current flowing through said solenoid winding.

* * * * *